US005823795A

United States Patent [19]

Schumacher

[11] Patent Number: 5,823,795

[45] Date of Patent: Oct. 20, 1998

[54] CONNECTOR BETWEEN A DAUGHTERBOARD AND A MOTHERBOARD FOR HIGH-SPEED SINGLE-ENDED ELECTRICAL SIGNALS

[75] Inventor: Richard A. Schumacher, Dallas, Tex.

[73] Assignee: Hewlett-Packard Company, Palo Alto, Calif.

[21] Appl. No.: 741,088

[22] Filed: Oct. 30, 1996

[51] Int. Cl.[6] ..... H01R 9/09

[52] U.S. Cl. ..... 439/76.1; 439/607; 439/74

[58] Field of Search ..... 439/65, 74, 75, 439/66, 76.1, 607, 638

[56] References Cited

U.S. PATENT DOCUMENTS

| | | | |
|---|---|---|---|
| 4,678,252 | 7/1987 | Moore | 439/62 |
| 4,717,344 | 1/1988 | Schempp et al. | 439/61 |
| 4,798,544 | 1/1989 | Hartman | 439/404 |
| 4,867,696 | 9/1989 | Demler, Jr. et al. | 439/212 |
| 4,869,676 | 9/1989 | Demler, Jr. et al. | 439/79 |
| 4,917,616 | 4/1990 | Demler, Jr. et al. | 439/101 |
| 4,971,574 | 11/1990 | Garcia | 439/497 |
| 5,152,700 | 10/1992 | Bogursky et al. | 439/733 |
| 5,199,895 | 4/1993 | Chang | 439/326 |
| 5,205,739 | 4/1993 | Malo et al. | 439/66 |
| 5,212,348 | 5/1993 | Gibson | 174/74 |
| 5,259,773 | 11/1993 | Champion et al. | 439/108 |
| 5,277,595 | 1/1994 | Clark | 439/75 |
| 5,417,584 | 5/1995 | Knott | 439/460 |
| 5,498,167 | 3/1996 | Seto et al. | 439/74 |
| 5,556,286 | 9/1996 | Ikesugi et al. | 439/74 |

*Primary Examiner*—Neil Abrams
*Attorney, Agent, or Firm*—Cynthia S. Baan

[57] ABSTRACT

An assembly of two printed circuit boards (PCBs) mounted either perpendicular to or parallel to each other within a housing, each PCB bearing one or more low-profile high-density board-to-board commodity connectors providing equal numbers of electrical contacts. These commodity connectors mate to connectors permanently mounted on the daughterboard and backplane/sideplane. The assembly housing provides for semi-permanent attachment of the assembly to either the daughterboard or to the backplane/sideplane, as desired for a particular application. The housing may be made of conductive material in contact with earth ground to provide electromagnetic interference (EMI) shielding. Electrical continuity between the PCBs within the assembly is provided by signal conductors of specified electrical impedance and propagation delay. Each end of each signal conductor serves a pair of adjacent contacts in the connectors of both PCBs, such that each signal contact is adjacent to the shield contact of the same conductor, and adjacent only to the shield contacts served by other conductors, and not adjacent to the signal contacts served by other conductors. Multiple connector contacts may be provided for each conductor's shield, to further reduce shield (return path) inductance.

20 Claims, 4 Drawing Sheets

CONNECTOR BETWEEN A DAUGHTERBOARD AND A MOTHERBOARD FOR HIGH-SPEED SINGLE-ENDED ELECTRICAL SIGNALS

FIELD OF THE INVENTION

The present invention relates generally to the field of electrical connectors and more particularly to an electrical connector for establishing high-speed signal and power interconnection between printed circuit boards.

BACKGROUND OF THE INVENTION

Printed circuit board connectors for coupling daughterboards to backpanels/motherboards are well known in the art. The most common prior art involves the connection of daughterboards at a right angle to a motherboard forming a "cage", but it is also known to connect the daughterboards so that they are parallel to the motherboard. The connection between the daughterboards and the motherboards is generally intended to provide for the transmission of power, ground and electrical signals between the daughterboard and the motherboard. Typically, as the bandwidth (speed of the electrical signals) and the signal density between the daughterboards and the motherboard increases and the actual number of signal connections between the daughterboards and the motherboard, there is a greater premium on signal integrity, reduced EMI emissions, reduced susceptibility to EMI, improved impedance control for each signal path, reduced crosstalk between signal paths, reduced return path inductance, and more precise time-matching between signal paths.

Accordingly, there is a need for a connection that provides signal integrity for high-speed (wide bandwidth) electrical signals between daughterboards and backplanes/motherboards, while maintaining or exceeding the signal density of existing high-speed signal connectors.

SUMMARY OF THE INVENTION

The above and other aspects of the present invention are accomplished in an assembly, consisting of two printed circuit boards (PCBs) mounted to each other within a housing, each PCB bearing one or more low-profile high-density, board-to-board commodity connectors providing equal numbers of electrical contacts. These commodity connectors mate to connectors permanently mounted on the daughterboard and backplane/motherboard. The assembly housing provides for semi-permanent attachment of the assembly to either the daughterboard or the backplane/motherboard. The assembly housing may be made of structurally strong, electrically conductive material in contact with earth ground to provide EMI shielding. Electrical continuity between the PCBs within the assembly is provided by transmission line signal conductors, such as coaxial, twinaxial, shielded twisted pair or unshielded twisted pair cables of specified electrical impedance and propagation delay. Each end of each cable serves a pair of adjacent contacts in the connectors of both PCBs, such that each signal contact is adjacent to the shield contact of the same cable, and adjacent only to the shield contact served by other cables, and not adjacent to the signal contacts served by other cables. Multiple connector contacts may be provided for each cable shield, to further reduce shield (return path) inductance.

BRIEF DESCRIPTION OF THE DRAWINGS

The above and other objects, features and advantages of the present invention will be better understood by reading the following more particular description of the invention, presented in conjunction with the following drawing, wherein.

DETAILED DESCRIPTION OF THE PREFERRED EMBODIMENT

The connector assembly comprising the preferred embodiment of the present invention is intended to establish an interconnection between two printed circuit boards employed in a backplane assembly used in a computer or similar electronic component. The electrical connector comprising the preferred embodiment of the present invention depicted herein is a high speed, high density matched impedance connector having low crosstalk between adjacent signals. The dimensions of the components of this connector can be chosen such that any impedance discontinuity incidental to the interconnection is negligible.

Figure 1A:
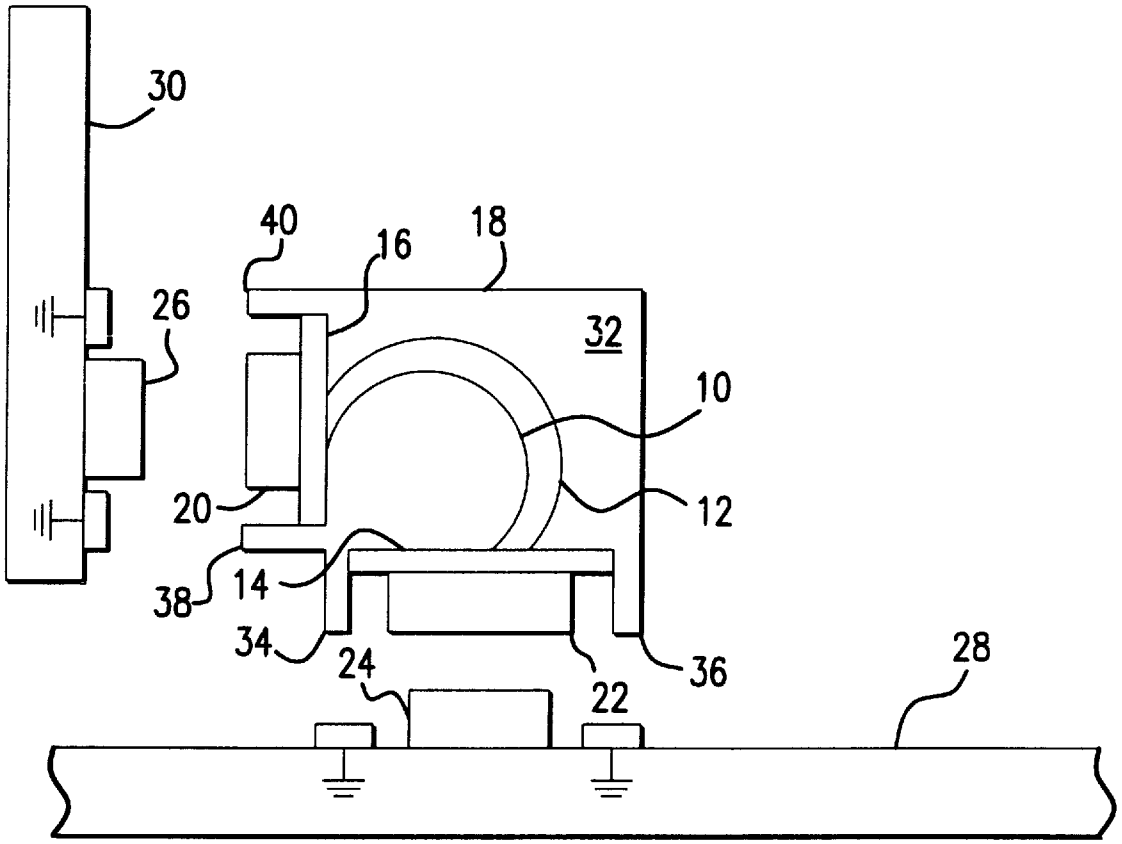
FIG. 1A illustrates a right-angle, high speed connector for electrically and mechanically connecting two printed circuit boards perpendicular to each other according to a first embodiment of the present invention.

Referring now to FIG. 1A, a right-angle, high speed connector 32 according to the present invention is illustrated. One or more daughterboards 30 are connected to a motherboard 28 by means of a high-speed connector 32. Daughterboards are typically printed circuit boards made of fiberglass and loaded with application specific electronic components and semiconductors, but may be made of any like material. Motherboards are also typically made of fiberglass and generally contain the power and microprocessing means for the computer system or electronic component. High-speed connector 32 comprises a first printed circuit board (PCB) 16 electrically connected to a second printed circuit board (PCB) 14 by means of signal conductors 10 and 12.

Printed circuit boards 14 and 16 may be made of fiberglass or any known like material. Signal conductors 10 and 12 may be any conventional, controlled impedance signal conductors, such as twinax cables, coaxial cables, shielded twisted pair cables (consisting of one shield and two signal conductors) or unshielded twisted pair cables, as appropriate for the application. For single-ended (non-differential) signals, coaxial cables are considered to be most appropriate, such as Gore CXF-3690 or equivalent. Customized assemblies may mix different types of signal conductors. The impedance of the signal conductors 10 and 12 can be selected to match the circuit impedance in the circuit boards 28 and 30 which the connector assembly 32 mates together (typically between 25 and 100 ohms or more typically about 50 ohms). There may be circumstances in which the impedance would be deliberately mismatched between the connector assembly 32 and one or more of the circuit boards 28 and 30 being mated. Customized assemblies using signal conductors chosen with various impedances on the various signal paths are also possible. The point is that the connector assembly 32 of the present invention permits impedance control for each signal path within the signal conductor in order to support specific circuit requirements, such as time critical paths, etc. On the other hand, the typical edge connector assembly of the prior art generally requires all signal paths to have the same impedance, but various propagation delays on different signal paths.

Precise time-matching of signals is achieved by matching the lengths of all signal paths in the assembly 32 (i.e., signal conductors 10 and 12, PCB signal etch and connector pin lengths) and by using controlled impedance signal conductors which also have a predetermined signal propagation speed. The lengths of the signal conductors 10 and 12 would normally be chosen to make the travel time through the connector equal over all signal paths. Knowing the intrinsic speed of the signal conductors 10 and 12, in some cases one might customize the assembly 32 by specifying various lengths for different signal conductors in the assembly to compensate for some known variation in the timing of the signal paths in the mated circuit boards 28 and 30.

It should be noted that only two signal conductors 10 and 12 are shown in order to simplify the discussion. However, typically there will be a plurality of signal conductors comprising the connection between a motherboard and a daughterboard, upwards of 40 or more signals per inch of connector (using a commodity connector with 0.050 inch pin spacing with a 1:1 signal to ground ratios allows 40 or more signals per inch of connector). PCB 16 is also connected to a commodity connector 20 that matingly attaches to commodity connector 26 on daughterboard 30. PCB 14 is connected to a commodity connector 22 that matingly attaches to commodity connector 24 on motherboard 28.

Commodity connectors 20, 22, 24, and 26 may be any known high density, low profile commodity connectors, which do not significantly degrade the signals, such as Mill-max pin and socket pair 0529 and 3006, or Molex pin and socket pair 87089 and 79108, or Molex 87239 straddle mount header plus Mill-max series 0680 socket. Commodity connectors 20, 22, 24 and 26 should have relatively short signal path lengths. More particularly, connectors with very short pin and socket contacts in comparison to the wavelengths of typical signals cause negligible signal degradation.

Reduced signal return path inductance is also provided by the connector assembly 32. That is, there will be less ground bounce across the assembly caused by the passage of signal transitions through the assembly than that caused by the passage of signals through other types of connectors. Existing connectors without impedance control generally present a large impedance discontinuity to signals, unless large numbers of pins are dedicated to the reference voltage (usually ground), existing controlled impedance connectors achieve this but have a low signal density (i.e., they carry fewer signals for their size).

The high-speed connector assembly 32 will probably not provide reduced power return path inductance compared to other available connectors, and therefore, is not the best connector to conduct power, except when the impedance is determined to be acceptable for a given application (e.g., when the power current will be constant or nearly so).

Figure 1B:
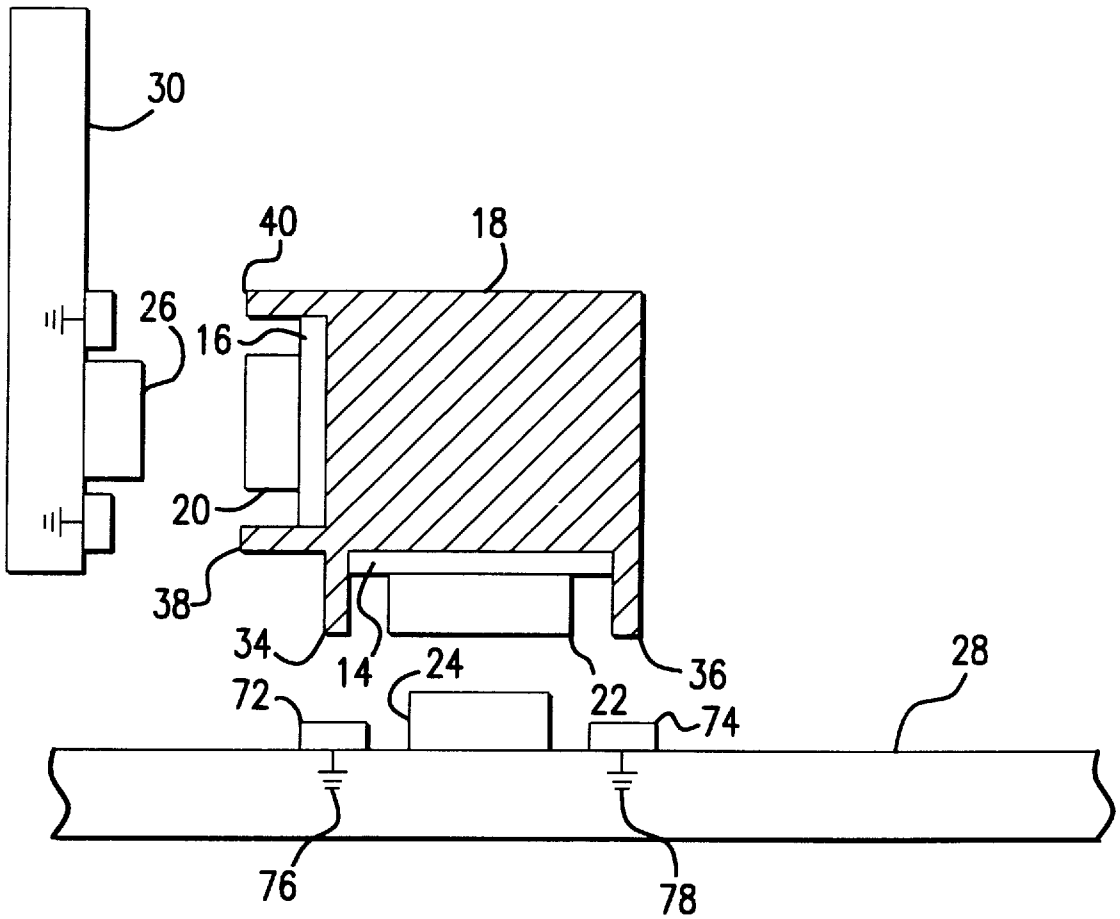
FIG. 1B illustrates a right-angle, high speed connector for electrically and mechanically connecting two printed circuit boards perpendicular to each other according to a second embodiment of the present invention.

PCBs 14 and 16 and impedance controlled signal conductors 10 and 12 are surrounded by assembly housing 18, which may be made of an electrically conductive material, such as aluminum and connected to earth ground 76 and 78 via connection means 72 and 74 on motherboard 28, which is well known, in order to provide EMI shielding for the signals, or to connect and maintain the continuity of EMI shielding between the motherboard and daughterboard as shown in FIG. 1B. Assembly housing 18 may also be a rigid material, such as aluminum so that legs 34, 36, 38 and 40 may provide structural support maintaining daughterboard 30 in a substantially perpendicular position relative to motherboard 28. Aluminum is contemplated as the most appropriate material to manufacture assembly housing 18 out of, however, any electrically conductive, structurally sturdy material may be used to manufacture assembly housing 18. Also, in the case of single-ended signals, the use of coaxial cable as the signal conductors 10 and 12, and short pin lengths in the commodity connectors 20, 22, 24 and 26 reduces EMI and susceptibility to EMI. In the case of differential signals, there is no particular improvement in EMI or susceptibility to EMI.

Figure 2:
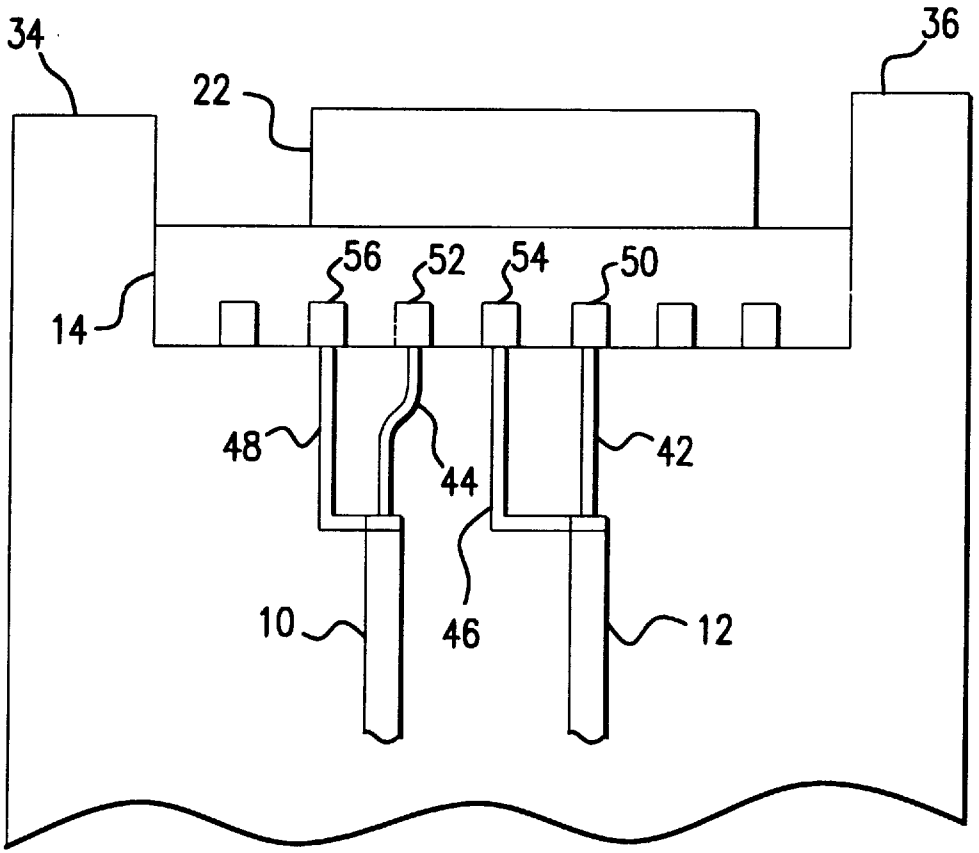
FIG. 2 illustrates the connection of coaxial cables to a printed circuit board.

FIG. 2 shows a schematic illustration of the connection of coaxial cables 10 and 12 to the PCB 14 connected to commodity connector 22. Specifically, outer shielding 46 and 48 of coaxial cables 10 and 12 are prepared for attachment. Then center signal conductors 42 and 44 of coaxial cables 10 and 12 are soldered or otherwise connected to PCB signal contact pads 50 and 52 and the outer shield members 46 and 48 are soldered or otherwise connected to PCB ground contact pads 54 and 56 via the tines. Accordingly, each signal contact pad 50 and 52 on the PCB 14 is adjacent to the shield contact pad of the same cable, and adjacent only to the shield contact pads of other cables, and not adjacent to the signal contact pads of other cables. Both ends of the coaxial cables 10 and 12, etc. are connected to the PCBs 14 and 16 in this manner. The connection of the outer shield members between the signal members and the shortness of the connection pins in the commodity connectors 20/26 and 22/24 provides reduced crosstalk between the signal paths.

It should be noted that signal conductors 42 and 44 do not have to be separated by the shielding 46 and 48 at the connection site on the PCBs 14 and 16. For certain applications that require less stringent crosstalk control, connecting the signal conductors 42 and 44 without separation by the shielding 46 and 48 is acceptable as by attaching signal conductors 42 and 44 on one side of PCBs 14 and 16, and by attaching the shield conductors 46 and 48 on the opposite sides of PCBs 14 and 16 may be acceptable, and may simplify and reduce the cost of the assembly.

It should also be noted that the contacts 50, 52, 54, and 56 on PCBs 14 and 16 are electrically negligible if they are sufficiently short (i.e., smaller than 1/10th of the wavelength of the highest-frequency signals to be transmitted). Existing controlled-impedance right-angle connectors have relatively long contacts. The contacts 50, 52, 54, and 56 on PCBs 14 and 16 do not necessarily need controlled impedance, because the contacts 50, 52, 54, and 56 are kept very short. Accordingly, most of the signal path length is in the cable material (coaxial, twinaxial, shielded twisted pair, or unshielded twisted pair) which has very high bandwidth and very minimal crosstalk coupling.

Figure 3:
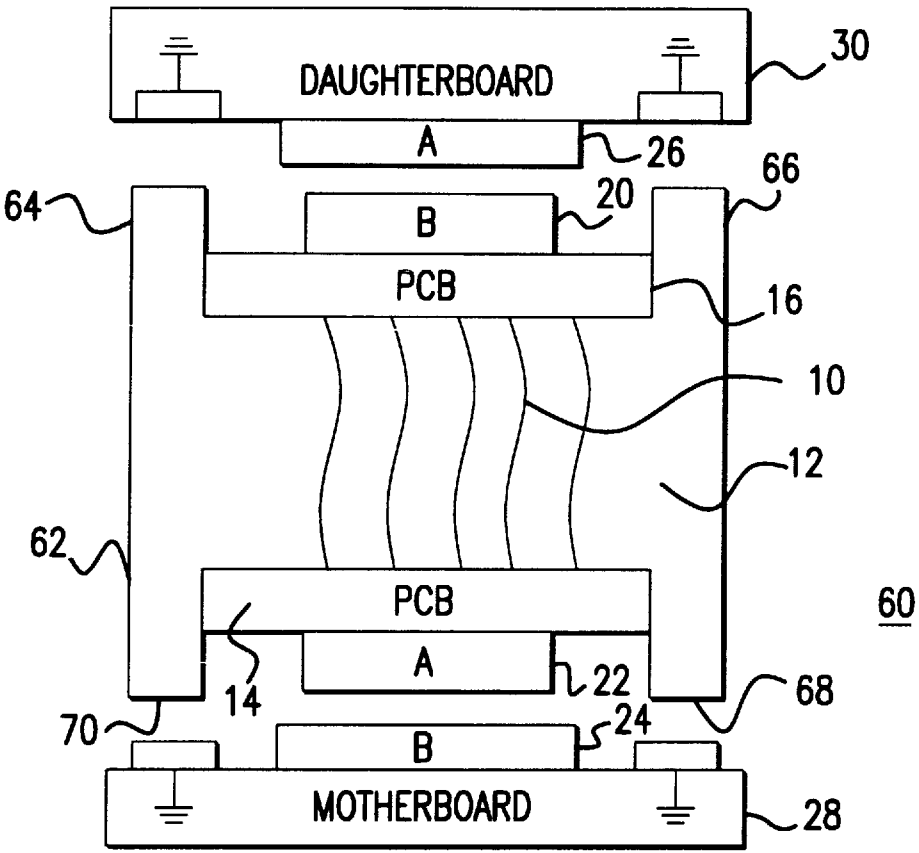
FIG. 3 illustrates high-speed connector for electrically and mechanically connecting two printed circuit boards in parallel with each other according to a third embodiment to the present invention.

FIG. 3 shows a high-speed connector assembly 60 for connecting a daughterboard 30 in parallel to a motherboard 28. All like features between FIGS. 1 and 3 are labeled with the same reference numbers. Accordingly, it can be seen that the housing member 62 structurally maintains the printed circuit boards 28 and 30 in parallel with legs 64, 66, 68 and 70 providing structural support. High-speed connector assembly 60 is identical to high-speed connector assembly 32 in every other respect.

An alternative embodiment may comprise multiple PCBs 14*a*, 14*b*, etc. mounted parallel to each other within the housing and perpendicular to circuit board 28, and multiple PCBs 16*a*, 16*b*, etc. mounted parallel to each other within the housing and perpendicular to circuit board 30. This embodiment is readily visible from FIGS. 1 and 3 and may be a superior embodiment by allowing more signals in one housing and by being easier to assemble.

The foregoing description of the present invention has been presented for purposes of illustration and description. It is not intended to be exhaustive or to limit the invention to the precise form disclosed, and other modifications and variations may be possible in light of the above teachings. For example, in some applications, it might be advantageous to make a permanent connection between the connector assembly 32 and one of the mated circuit boards 28 and 30 by means of solder or other known means of permanently connecting printed circuit boards. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A high-speed connector assembly for electrically and mechanically connecting a first printed circuit board having a first commodity connector attached thereto to a second printed circuit board having a second commodity connector attached thereto, said high-speed connector assembly comprising:

a housing member having a first side and a second side;

a third commodity connector along said first side of said housing member, said third commodity connector capable of being mated with said first commodity connector on said first printed circuit board;

a third printed circuit board attached to said third commodity connector;

a fourth commodity connector along said second side of said housing member, said fourth commodity connector capable of being mated with said second commodity connector on said second printed circuit board;

a fourth printed circuit board attached to said fourth commodity connector;

at least one impedance controlled, signal conductor having a first end and a second end, said first end of said at least one impedance controlled, signal conductor attached to said third printed circuit board, said second end of said at least one impedance controlled, signal conductor attached to said fourth printed circuit board, wherein at least one signal path exists between said first printed circuit board and said second printed circuit board when said first commodity connector is mated to said third commodity connector and said second commodity connector is mated with said fourth commodity connector, said at least one signal path traversing back and forth from said first commodity connector to said third commodity connector to said third printed circuit board to said at least one impedance controlled, signal conductor to said fourth printed circuit board to said fourth commodity connector to said second printed circuit board.

2. The high-speed connector assembly according to claim 1 wherein said housing member is made of a conductive material.

3. The high-speed connector assembly according to claim 2 wherein said housing member is connected to earth.

4. The high-speed connector assembly according to claim 3 wherein said housing member is made of aluminum.

5. The high-speed connector assembly according to claim 1 wherein said housing member is made of a sufficiently hard material to provide structural support to said first printed circuit board assembly and said second printed circuit board assembly.

6. The high-speed connector assembly according to claim 1 wherein said first printed circuit board and said second printed circuit board are perpendicular to each other.

7. The high-speed connector assembly according to claim 6 wherein said first side of said housing member and said second side of said housing member are perpendicular to each other.

8. The high-speed connector assembly according to claim 1 wherein said first printed circuit board and said second printed circuit board are parallel to each other.

9. The high-speed connector assembly according to claim 8 wherein said first side of said housing member and said second side of said housing member are parallel to each other.

10. The high-speed connector assembly according to claim 1 wherein said at least one impedance controlled, signal conductor comprises at least one coaxial cable.

11. The high-speed connector assembly according to claim 10 wherein said at least one coaxial cable is a predetermined length such that signals traveling between said first printed circuit board and said second printed circuit board have predetermined propagation delays.

12. The high-speed connector assembly according to claim 1 wherein said at least one impedance controlled, signal conductor comprises at least one twinaxial cable.

13. The high-speed connector assembly according to claim 1 wherein said at least one impedance controlled, signal conductor comprises at least one shielded twisted pair cable.

14. The high-speed connector assembly according to claim 1 wherein said at least one impedance controlled, signal conductor comprises at least one unshielded twisted pair cable.

15. A high-speed connector assembly for electrically and mechanically connecting a first printed circuit board having a first commodity connector attached thereto to a second printed circuit board having a second commodity connector attached thereto, said high-speed connector assembly comprising:

a housing member having a first side and a second side;

a third commodity connector along said first side of said housing member, said third commodity connector capable of being mated with said first commodity connector on said first printed circuit board;

a third printed circuit board attached to said third commodity connector;

a fourth commodity connector along said second side of said housing member, said fourth commodity connector capable of being mated with said second commodity connector on said second printed circuit board;

a fourth printed circuit board attached to said fourth commodity connector;

a plurality of impedance controlled, signal conductors having a first end and a second end, said first end of each of said plurality of impedance controlled, signal conductors attached to said third printed circuit board, said second end of each of said plurality of impedance controlled, signal conductors attached to said fourth printed circuit board, wherein a plurality of signal paths exist between said first printed circuit board and said second printed circuit board when said first commodity connector is mated to said third commodity connector and said second commodity connector is mated with said fourth commodity connector, said plurality of signal paths traversing back and forth from said first commodity connector to said third commodity connector to said third printed circuit board to said plurality impedance controlled, signal conductors to said fourth printed circuit board to said fourth commodity connector to said second printed circuit board.

16. The high-speed connector assembly according to claim 15 wherein each of said plurality of impedance controlled signal conductors comprises a coaxial cable having a first end and a second end.

17. The high-speed connector assembly according to claim 16 wherein each coaxial cable comprises a shield and a signal conductor.

18. The high-speed connector according to claim 17 wherein the first end of each coaxial cable is connected to said third printed circuit board in such a manner that a signal conductor of any single coaxial cable is adjacent to its own shield and the shield of another coaxial cable, each signal conductor is separated from every other signal conductor by a shield at the location of connection to the third printed circuit board, and no signal conductor connected to said third printed circuit board is adjacent to another signal conductor connection.

19. The high-speed connector according to claim 18 wherein the second end of each coaxial cable is connected to said fourth printed circuit board in such a manner that a signal conductor of any single coaxial cable is adjacent to its own shield and the shield of another coaxial cable, each signal conductor is separated from every other signal conductor by a shield at the location of connection to the fourth printed circuit board, and no signal conductor connected to said fourth printed circuit board is adjacent to another signal conductor connection.

20. The high-speed connector assembly according to claim 17 wherein each shield and each signal conductor of each coaxial cable is soldered to said third printed circuit board and said fourth printed circuit board.

* * * * *